US007179054B1

(12) United States Patent
Borges

(10) Patent No.: US 7,179,054 B1
(45) Date of Patent: Feb. 20, 2007

(54) FLOW REVERSAL SYSTEM FOR AXIAL FAN

(75) Inventor: Guy F. Borges, Somerset, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 396 days.

(21) Appl. No.: 10/847,681

(22) Filed: May 14, 2004

(51) Int. Cl.
*F04D 15/00* (2006.01)

(52) U.S. Cl. ..... 416/31; 416/137; 416/153; 416/159; 416/164; 415/13; 415/129; 454/257

(58) Field of Classification Search ..... 416/31, 416/46–48, 136, 137, 157 R, 153–156, 159, 416/160, 164; 415/13, 33, 129; 454/257
See application file for complete search history.

(56) References Cited

U.S. PATENT DOCUMENTS

| | | | | |
|---|---|---|---|---|
| 263,618 | A * | 8/1882 | Stickler | 415/137 |
| 3,219,122 | A * | 11/1965 | Montgomerie et al. | 416/136 |
| 4,124,330 | A | 11/1978 | Barnes | |
| 4,179,241 | A | 12/1979 | Courshon, Jr. | |
| 4,844,697 | A | 7/1989 | Johansen | |
| 5,427,502 | A * | 6/1995 | Hudson | 415/211.1 |
| 5,464,324 | A | 11/1995 | Langenberg | |
| 5,762,474 | A | 6/1998 | Chatelain | |
| 6,113,351 | A | 9/2000 | McCallum et al. | |
| 6,253,716 | B1 * | 7/2001 | Palmer et al. | 416/36 |
| 6,439,850 | B1 | 8/2002 | McCallum et al. | |
| 6,729,844 | B2 * | 5/2004 | Bettencourt | 416/156 |

FOREIGN PATENT DOCUMENTS

| | | | | |
|---|---|---|---|---|
| DK | 70616 A | * | 1/1950 | 416/160 |
| GB | 885927 A | * | 1/1962 | 416/159 |
| GB | 2077855 A | * | 12/1981 | 416/157 R |
| JP | 62-291499 A | * | 12/1987 | 416/160 |

* cited by examiner

*Primary Examiner*—Christopher Verdier
(74) *Attorney, Agent, or Firm*—Jean-Paul A. Nasser; James M. Kasischke; Michael P. Stanley

(57) ABSTRACT

An axial fan has a blade support wheel coupled to a drive shaft. A disk is positioned about the drive shaft adjacent the wheel. A torsion spring is coupled to the wheel and to the disk. When the torsion spring is in tension, the disk is poised for a relative rotation about the drive shaft. A lock couples the disk to the wheel when the torsion spring is in tension. Fan blades are supported by the wheel, and are coupled to the disk. Rotation of the drive shaft rotates the fan blades generating a specific flow direction. To reverse the flow direction, a release mechanism uncouples the lock from the disk and wheel causing the disk to experience rotation about the drive shaft as tension in the torsion spring is released. The disk's relative rotation re-positions the fan blades reversing the flow direction as the drive shaft continues to rotate.

18 Claims, 2 Drawing Sheets

FLOW REVERSAL SYSTEM FOR AXIAL FAN

STATEMENT OF GOVERNMENT INTEREST

The invention described herein may be manufactured and used by or for the Government of the United States of America for Governmental purposes without the payment of any royalties thereon or therefore.

CROSS REFERENCE TO OTHER RELATED APPLICATIONS

Not applicable.

BACKGROUND OF THE INVENTION (1) Field of the Invention

The present invention relates generally to axial fans, and more particularly to a flow reversal system for an axial fan that quickly reverses the flow of fluid through the fan without changing the rotational direction or speed of the fan.

(2) Description of the Prior Art

Fan arrangements in conventional air handling systems utilize motor driven fan wheels that draw ventilation air from the outdoors through ducts, louvers and dampers. Although these fan systems may be able to vary their speed and capacity, they almost always have significant amounts of rotational inertia in the fan wheel/motor assembly that can require minutes for the fan wheel to completely stop rotating after the motor has been turned off. However, in situations where air contaminants are detected, it is desirable to shut down the air flow as soon as possible and even reverse same to purge the contaminated air from an indoor environment.

Typically, when contaminants are detected, fan motors are shut off and dampers are used to shut off an air flow in a duct. The use of dampers to rapidly seal off air flow is problematic since most fast-acting damper assemblies are not capable of a completely tight seal. Further, damper seals experience very high pressure excursions when a fan discharge is rapidly closed off. These factors make it extremely difficult to devise a scheme that quickly stops the flow of outdoor air being drawn into an air handling system upon detection of contaminants in that air stream.

SUMMARY OF THE INVENTION

Accordingly, it is an object of the present invention to provide a system that can quickly reverse the flow of fluid caused by a fan.

Another object of the present invention is to provide a flow reversal system for an axial fan that can change the flow of fluid through the fan without changing the rotational speed or direction of the fan.

Other objects and advantages of the present invention will become more obvious hereinafter in the specification and drawings.

In accordance with the present invention, a flow reversal system is provided for use with an axial fan having a drive shaft that rotates about a longitudinal axis thereof. A blade support wheel is coupled at a central portion thereof to the drive shaft for rotation therewith. A disk is positioned about the drive shaft adjacent the blade support wheel. A torsion spring is coupled to the blade support wheel and to the disk such that, when the torsion spring is in tension, the disk is poised for a relative rotation about the drive shaft. The relative rotation is relative to the blade support wheel. A lock couples the disk to the blade support wheel when the torsion spring is in tension so that rotation of the blade support wheel causes corresponding rotation of the disk. Each of a plurality of fan blades has a stem rotationally supported by the blade support wheel so that a rotational position of the stem sets blade pitch for a corresponding one of the fan blades. Means are provided to couple each stem to the disk such that rotation of the drive shaft causes rotation of the fan blades about the drive shaft. The coupling of the stem to the disk also positions the fan blades to generate a flow therethrough when the drive shaft rotates with the lock coupling the disk to the blade support wheel while the torsion spring is in tension. Release means are coupled to the lock means when it is desired to uncouple the lock from the disk and blade support wheel. Specifically, when the release means is activated, the disk experiences relative rotation about the drive shaft as tension in the torsion spring is released. The relative rotation of the disk causes rotation of each stem thereby re-positioning the fan blades to reverse the flow therethrough as the drive shaft rotates.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
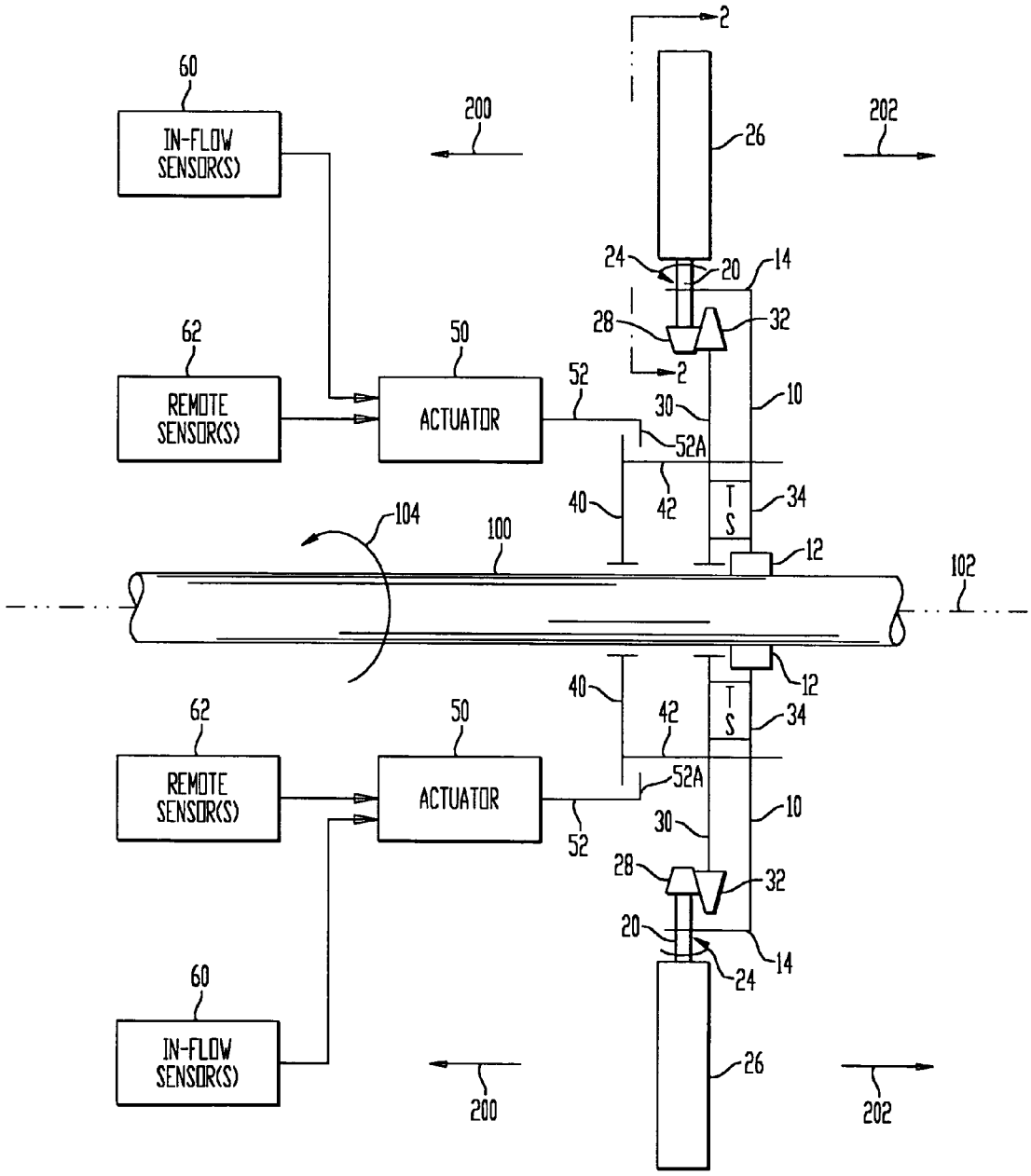
FIG. 1 is a schematic view of a flow reversal system for an axial fan in accordance with an embodiment of the present invention.

Referring now to the drawings, and more particularly to FIG. 1, the flow reversal system for an axial fan in accordance with the present invention is depicted schematically. As is known in the art, an axial fan is one that has a drive shaft 100 that rotates about its longitudinal axis 102 as shown by drive arrow 104. Powered rotation of drive shaft 100 can be achieved by a motor (not shown) coupled directly to drive shaft 100 or indirectly to drive shaft 100 by means of a belt or chain. Accordingly, it is to be understood that the type of axial fan and drive source are not limitations of the present invention.

Figure 2:
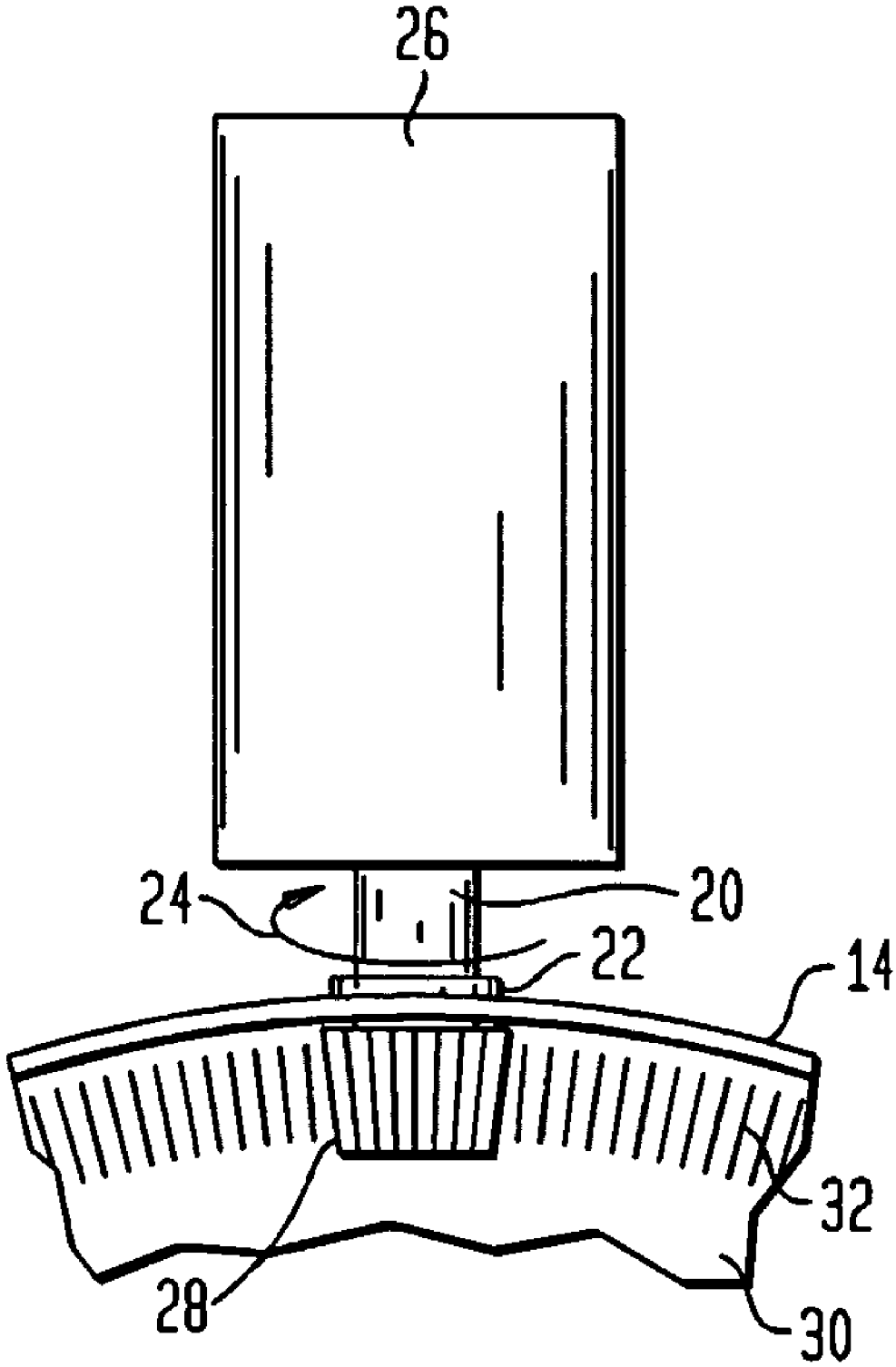
FIG. 2 is an isolated head-on view of a single fan blade illustrating the relationship between the blade support wheel and geared disk as viewed along line 2—2 in FIG. 1.

A wheel 10 is coupled at coupling 12 to drive shaft 100 for rotation therewith. Wheel 10 is rigid and has an annular flange 14 at its peripheral edge. Rotatably supported in annular flange 14 are a plurality of spaced apart fan blade stems 20. More specifically, as best seen in FIG. 2, each stem 20 passes through annular flange 14 and is supported in a bushing 22 that supports rotation of stem 20 as indicated by arrow 24. Coupled to each stem 20 outside of annular flange 14 is a fan blade 26, the size and shape of which are not limitations of the present invention. Although only two blade/stem combinations are shown, it is to be understood that additional blades/stems can be used without departing from the scope of the present invention. Coupled to each stem 20 inside of annular flange 14 is a bevel gear 28.

A disk 30 is disposed about drive shaft 100 but is not directly coupled thereto. That is, the rotation of drive shaft 100 is not directly coupled to disk 30. One face of disk 30 is configured with gear teeth 32 (as best seen in FIG. 2) that engage the teeth of bevel gear 28. As a result, independent rotation of disk 30 about drive shaft 100 results in rotation (indicated by arrow 24) of each bevel gear 28/stem 20/fan blade 26 combination, The bevel gear 28/stem 20 serve as a means for reversing the pitch of the fan blade 26. Conversely, the prevention of any independent rotation of disk 30 about drive shaft 100 fixes the position of each bevel gear 28/stem 20/fan blade 26 combination thereby fixing the pitch of each fan blade 26.

A torsion spring ("TS" in FIG. 1) 34 is coupled to each of wheel 10 and disk 30. Torsion spring 34 is any spring device that, when in tension, can generate a rotational force on disk 30 such that disk 30 can rotate about drive shaft 100 relative to wheel 10. A variety of such spring devices are known in the art and include, but are not limited to, spiral or helical clock-type springs disposed about drive shaft 100, coil spring(s) cooperating between fixed mounts on each of wheel 10 and disk 30, etc.

According to the present invention, the position of disk 30 relative to wheel 10 is limited to one of two (pitch) positions. In this way, the position of each fan blade 26 is limited to one of two positions. The first of these positions is defined when torsion spring 34 is placed in tension, i.e., disk 30 is rotated about drive shaft 100 until fan blades 26 are positioned such that their rotation about drive shaft 100 produces a flow of the surrounding fluid medium (e.g., air or other gas) in a first direction. By way of illustrative example, the first flow direction is indicated by directional arrow 200.

It is necessary to fix or lock disk 30 in position relative to wheel 10 when torsion spring 34 is in tension in order to maintain the first position of fan blades 26. One way of doing this is to provide a plate 40 that is disposed about drive shaft 100 such that plate 40 and drive shaft 100 are not coupled to one another. Extending from plate 40 and parallel to longitudinal axis 102 are a plurality (e.g., two are shown in FIG. 1) of locking pins 42 that are long enough to engage receiving holes (not shown) formed in the faces of each of disk 30 and wheel 10. The combination of plate 40 disposed about drive shaft 100 with locking pins 42 extending from plate 40 serve as a locking means for lock disk 30 in position relative to wheel 10. By locking wheel 10 and disk 30 together with torsion spring 34 in tension, rotation of drive shaft 100 is translated through disk 30 to each of fan blades 26 to generate fan flow 200. Note that plate 40/pins 42 rotate about drive shaft 100 when wheel 10 and disk 30 are locked together.

The present invention provides for the complete reversal of fan flow 200 without requiring any change in the rotational speed or direction of drive shaft 100. By way of illustrative example, one or more actuators 50 (e.g., electromagnetic, hydraulic, etc.) having actuator rods 52 extending therefrom can be configured with end plates 52A positioned such that plate 40 is not engaged by end plates 52A while fan flow 200 is being generated. However, when fan flow 200 must be reversed (i.e., such that reversed fan flow 202 is generated) actuator(s) 50 are activated so that rods 52 are axially retracted whereby end plates 52A engage plate 40. Engagement of plate 40 can be realized by this or other types of mechanical engagement of the peripheral edge or other portions of plate 40. However, it is to be understood that such engagement need not be mechanical. For example, electromagnetic forces could be applied to plate 40 in order to move it axially along drive shaft 100.

Regardless of the particular choice of motive force, flow reversal is achieved when plate 40 is pulled in a direction parallel to longitudinal axis 102 so that pins 42 are disengaged from wheel 10 and disk 30. Once pins 42 are disengaged, disk 30 rotates about drive shaft 100 (relative to wheel 10) under the tension of torsion spring 34. The tension supplied by torsion spring 34 should be sufficient to rotate disk 30 to a position that correspondingly rotates each fan blade 26 to a position that generates reversed fan flow 202 as drive shaft 100 continues to rotate.

The advantages of the present invention are numerous. Fan flow is quickly reversed since no motor deceleration or change of direction is required. Thus, the present invention is ideally suited for use in ventilation systems where change in conditions may warrant a reversal of fan flow. Accordingly, a variety of condition sensors may be placed in and/or remotely with respect to the fan flow to detect such conditions. Detection of such condition(s) can then be used to trigger activation of actuators 50. The condition sensor(s) can include sensor(s) 60 placed in fan flow 200 and/or sensor(s) 62 placed remotely with respect to fan flow 200. In terms of ventilation systems, sensors 60 and/or 62 can be contaminant sensors that trigger activation of actuators 50 when contaminants are detected. Note that the output of sensors 60 and 62 could also be used to trigger other components that are affected by fan flow reversal. For example, filters (not shown) might normally positioned in the low-pressure side of fan blades 26 during fan flow 200. However, the presence of such filters during reversed fan flow 202 may impede such flow. Accordingly, the output of sensors 60 and 62 could also be used to trigger components/systems used to move or remove such filters or other obstructions during reversed fan flow 202.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A ventilating device comprising:

a drive shaft that rotates about a longitudinal axis thereof;

a blade support wheel coupled at a central portion thereof to the drive shaft for rotation of said blade support wheel with said drive shaft;

a plurality of fan blades joined to said blade support wheel capable of producing an airflow when said blade support wheel rotates;

a means for reversing pitch joined to each of said plurality of fan blades comprising a disk positioned about the drive shaft adjacent said blade support wheel;

at least one torsion spring coupled to said blade support wheel and to said disk wherein, when said at least one torsion spring is in tension, said disk is poised for a relative rotation about the drive shaft, said relative rotation being relative to said blade support wheel;

a locking means positioned between said disk and said blade support wheel for coupling said disk to said blade support wheel when said at least one torsion spring is in tension, wherein rotation of said blade support wheel causes corresponding rotation of said disk;

each of said plurality of fan blades having a stem rotationally supported by said blade support wheel wherein a rotational position of said stem sets blade pitch for a corresponding one of said plurality of fan blades;

a means for coupling each said stem to said disk wherein rotation of the drive shaft causes rotation of said plurality of fan blades about the drive shaft, said means for coupling each said stem to said disk positioning said plurality of fan blades to generate a flow therethrough when the drive shaft rotates with said locking means coupling said disk to said blade support wheel while said at least one torsion spring is in tension;

a release means coupled to said locking means for uncoupling said locking means from said disk and said blade support wheel when said release means is activated, wherein said disk experiences said relative rotation about the drive shaft as said tension in said at least one torsion spring is released, and wherein said relative rotation of said disk causes rotation of each said stem to re-position said plurality of fan blades to reverse said flow therethrough as the drive shaft rotates;

a sensor capable of sensing an event that will require reversing the air flow; and a controller joined to said sensor capable of actuating said means for reversing pitch in order to initiate the reversal of airflow upon the occurrence of said event.

2. A ventilating device as in claim 1 wherein said means for reversing pitch further comprises at least one actuator joined to each of said plurality of fan blades capable of reversing pitch thereby reversing the air flow.

3. A ventilating device as in claim 1 wherein said sensor is disposed in said flow.

4. A ventilating device as in claim 3 wherein said sensor is a contaminant sensor.

5. A ventilating device as in claim 1 wherein said locking means comprises:

a plate positioned about the drive shaft adjacent said disk; and a plurality of pins coupled to and extending from said plate in a direction parallel to the longitudinal axis of the drive shaft, said plurality of pins engaging each of said disk and said blade support wheel when said at least one torsion spring is in tension.

6. A ventilating device as in claim 5 wherein, when activated, said release means engages said plate and pulls said plate along the longitudinal axis of the drive shaft until said plurality of pins are disengaged from said blade support wheel and said disk wherein said disk experiences said relative rotation.

7. A flow reversal system for an axial fan having a drive shaft that rotates about a longitudinal axis of said drive shaft, said flow reversal system comprising:

a blade support wheel coupled at a central portion thereof to the drive shaft for rotation of said blade support wheel with said drive shaft, said blade support wheel incorporating an annular flange at its periphery;

a disk positioned about the drive shaft adjacent said blade support wheel and fitted within a region defined by said annular flange;

at least one torsion spring coupled to said blade support wheel and to said disk wherein, when said at least one torsion spring is in tension, said disk is poised for a relative rotation about the drive shaft, said relative rotation being relative to said blade support wheel;

lock means for coupling said disk to said blade support wheel when said at least one torsion spring is in tension, wherein rotation of said blade support wheel causes corresponding rotation of said disk;

a plurality of fan blades, each of said plurality of fan blades having a stem, each said stem passing through said annular flange and being capable of free rotation therein, wherein a rotational position of said stem sets blade pitch for a corresponding one of said plurality of fan blades;

means for coupling a portion of each said stem passed through said annular flange to said disk wherein rotation of the drive shaft causes rotation of said plurality of fan blades about the drive shaft, said means for coupling a portion of each said stem passed through said annular flange to said disk positioning said plurality of fan blades to generate a flow therethrough when the drive shaft rotates with said lock means coupling said disk to said blade support wheel while said at least one torsion spring is in tension; and release means coupled to said lock means for uncoupling said lock means from said disk and said blade support wheel when said release means is activated, wherein said disk experiences said relative rotation about the drive shaft as said tension in said at least one torsion spring is released, and wherein said relative rotation of said disk causes rotation of each said stem to re-position said plurality of fan blades to reverse said flow therethrough as the drive shaft rotates.

8. A flow reversal system as in claim 7 further comprising a sensor for sensing a condition that requires said flow to be reversed and for generating a signal indicative of said condition so-sensed, said sensor coupled to said release means wherein said signal triggers activation of said release means.

9. A flow reversal system as in claim 8 wherein said sensor is disposed in said flow.

10. A flow reversal system as in claim 8 wherein said sensor is a contaminant sensor.

11. A flow reversal system as in claim 7 wherein said lock means comprises:

a plate positioned about the drive shaft adjacent said disk; and a plurality of pins coupled to and extending from said plate in a direction parallel to the longitudinal axis of the drive shaft, said plurality of pins engaging each of said disk and said blade support wheel when said at least one torsion spring is in tension.

12. A flow reversal system as in claim 11 wherein, when activated, said release means engages said plate and pulls said plate along the longitudinal axis of the drive shaft until said plurality of pins are disengaged from said blade support wheel and said disk wherein said disk experiences said relative rotation.

13. A flow reversal system for an axial fan having a drive shaft that rotates about a longitudinal axis of said drive shaft, said flow reversal system comprising:

a blade support wheel coupled at a central portion thereof to the drive shaft for rotation of said blade support wheel with said drive shaft, said blade support wheel incorporating an annular flange at its periphery;

a disk positioned about the drive shaft adjacent said blade support wheel and fitted within a region defined by said annular flange, said disk having gear teeth formed on a face thereof;

at least one torsion spring coupled to said blade support wheel and to said disk wherein, when said at least one torsion spring is in tension, said disk is poised for a relative rotation about the drive shaft, said relative rotation being relative to said blade support wheel;

lock means for coupling said disk to said blade support wheel when said at least one torsion spring is in tension, wherein rotation of said blade support wheel causes corresponding rotation of said disk;

a plurality of fan blades, each of said plurality of fan blades having a stem that terminates at an outboard end of each of said plurality of fan blades, each said stem passing through said annular flange and being capable of free rotation therein wherein a rotational position of said stem sets blade pitch for a corresponding one of said plurality of fan blades;

a bevel gear mounted on said outboard end of each said stem for engaging said gear teeth on said disk wherein rotation of the drive shaft causes rotation of said plurality of fan blades about the drive shaft, and wherein said plurality of fan blades are positioned to generate a flow therethrough when the drive shaft rotates with said lock means coupling said disk to said blade support wheel while said at least one torsion spring is in tension; and release means coupled to said lock means for uncoupling said lock means from said disk and said blade support wheel when said release means is activated, wherein said disk experiences said relative rotation about the drive shaft as said tension in said at least one torsion spring is released, and wherein said relative rotation of said disk causes rotation of each said stem to re-position said plurality of fan blades to reverse said flow therethrough as the drive shaft rotates.

14. A flow reversal system as in claim 13 further comprising a sensor for sensing a condition that requires said flow to be reversed and for generating a signal indicative of said condition so-sensed, said sensor coupled to said release means wherein said signal triggers activation of said release means.

15. A flow reversal system as in claim 14 wherein said sensor is disposed in said flow.

16. A flow reversal system as in claim 14 wherein said sensor is a contaminant sensor.

17. A flow reversal system as in claim 13 wherein said lock means comprises:

a plate positioned about the drive shaft adjacent said disk; and a plurality of pins coupled to and extending from said plate in a direction parallel to the longitudinal axis of the drive shaft, said plurality of pins engaging each of said disk and said blade support wheel when said at least one torsion spring is in tension.

18. A flow reversal system as in claim 17 wherein, when activated, said release means engages said plate and pulls said plate along the longitudinal axis of the drive shaft until said plurality of pins are disengaged from said blade support wheel and said disk wherein said disk experiences said relative rotation.

* * * * *